United States Patent [19]

Rothe

[11] Patent Number: 4,790,164

[45] Date of Patent: Dec. 13, 1988

[54] ROLLER ENTRY GUIDE

[76] Inventor: Herbert Rothe, Stöckstrasse 12, D-7570 Baden-Baden 24, Fed. Rep. of Germany

[21] Appl. No.: 51,748

[22] PCT Filed: Aug. 12, 1986

[86] PCT No.: PCT/EP86/00474

§ 371 Date: Apr. 17, 1987

§ 102(e) Date: Apr. 17, 1987

[87] PCT Pub. No.: WO87/01059

PCT Pub. Date: Feb. 26, 1987

[30] Foreign Application Priority Data

Aug. 19, 1985 [DE] Fed. Rep. of Germany ... 8523750[U]

[51] Int. Cl.[4] ..... B21B 39/16

[52] U.S. Cl. ..... 72/8; 72/19; 72/250; 226/177; 226/182

[58] Field of Search ..... 72/250, 19, 20, 8–12, 72/251, 252; 226/176, 177, 182

[56] References Cited

U.S. PATENT DOCUMENTS

| | | | |
|---|---|---|---|
| 2,342,374 | 2/1944 | Shayne et al. . | |
| 3,714,806 | 2/1973 | Berkey et al. | 72/19 |
| 4,073,173 | 2/1978 | Marshall et al. | 72/250 |
| 4,123,927 | 11/1978 | Brauer | 72/250 X |
| 4,590,778 | 5/1986 | Klockner et al. | 72/19 |

FOREIGN PATENT DOCUMENTS

| | | |
|---|---|---|
| 1060825 | 11/1956 | Fed. Rep. of Germany . |
| 2011423 | 3/1970 | Fed. Rep. of Germany . |
| 7415378 | 4/1974 | Fed. Rep. of Germany . |
| 2646006 | 4/1977 | Fed. Rep. of Germany . |
| 2327828 | 5/1977 | France . |
| 56-56717 | 5/1981 | Japan . |

OTHER PUBLICATIONS

"Stahl und Eisen", vol. 97/No. 19, 1977, pp. 921 to 926.

*Primary Examiner*—Robert L. Spruill
*Assistant Examiner*—Steven B. Katz
*Attorney, Agent, or Firm*—Bacon & Thomas

[57] ABSTRACT

A roller guide assembly for guiding rolled material between the passes of previous and subsequent roll stands, the assembly being provided with a pair of guide rollers supported for rotation about parallel axes for engaging opposite sides of the rolled material. A sensor detects engagement pressure transmitted to the guide rollers by the material and provides a correlating output signal for adjustment of the guide rollers to maintain constant engagement pressure against the material, thereby permitting compensation for any wear of the guide rollers and previous roll stand pass when the material enters the subsequent roll stand pass.

9 Claims, 1 Drawing Sheet

ROLLER ENTRY GUIDE

BACKGROUND OF THE INVENTION

1. Field of the Invention

The invention relates to a roller guide assembly, especially for a billet, bar or wire rolling-mill roll stand train.

2. Description of the Prior Art

Such roller guide assemblies serve to guide the materail to be rolled in a train roll stand with the right orientation into the pass of two grooved rolls of the roll stand and also to prevent any twisting of the material about its longitudinal axis as it runs through the roll pass, such twisting being likely to occur if the material has an elongated cross section, as for example the cross section of a diamond or an oval cross section, and if it runs upright between the two grooved rolls into a flat or circular pass thereof in order to be plastically deformed in such a way that its major cross section axis is shortened. In order to securely hold the material the roller guide assemblies include two guide rollers having an outline matching the shape of the material cross section and the axis-to-axis distance of which is so set in accordance with the cross section of the material to be rolled that the same runs between the two guide rollers in a completely play-free manner, which contact the material with a predetermined pressure. This relative adjustment of the guide rollers is generally undertaken outside the respective roll stand in a workshop using mechanical or optical measuring instruments, whereupon the roller guide assembly is fitted to the roll stand, a careful adjustment of the roller guide assembly relative to the respective roll pass being performed in order to ensure that the axes of the cross section of the material to be rolled are aligned with the axes of the pass cross section.

Generally the roller guide assemblies consist of a housing holding an entry guide member which guides the material to be rolled between the two guide rollers and two arms supporting the guide rollers and pivotally mounted on the housing for rocking about two axes parallel to the axes of rotation of the guide rollers, each rocking axis being located substantially in the center between the two ends of the respective supporting arms, on which the guide roller thereof is mounted for rotation and respectively a setting screw is disposed by which the supporting arm may be pivoted in relation to the housing on setting the axis-to-axis distance between the two guide rollers. The housing is adapted to be secured to a roll stand to be fitted with a roller guide assembly in a position which may be accurately set with respect to the roll pass of the roll stand.

Given meticulous adjustment, roller guide assemblies of this type make possible a very high rolling speed of up to 100 meter/sec, the guide rollers being supported on ball, roller or taper roller bearings, which are lubricated with an air-oil mixture. However, problems arise inasfar as although the guide rollers or their axis-to-axis distance are very accurately set at the start of the rolling process to a predetermined cross section of the material to be rolled, in a rolling-mill with a train of roll stands, this cross section will change owing to wear thereof, the wear of the grooved rolls and that of the guide rollers taking place at different rates. At high speeds of rolling these wear rates are also very high so that the rolling operation will become unsatisfactory after only a comparatively short time, because the rolling-mill roll stand train will have lost its correct adjustment. For this reason a further increase in the speed of rolling is regarded as being unpromising.

It is known to spring-load the guide roller supporting arms of such roller guide assemblies so that even in the case of a reduction in the cross section of the material passing therethrough one may be certain of an accurate guiding action and in the case of an increase in cross section the guide rollers and their bearings will not be over loaded (see German utility model 7,415,378 and German patent application 2,646,006). However, this does not make it possible to maintain the original adjustment of a roll stand train.

SUMMARY OF THE INVENTION

The object of the invention is to provide a roller guide assembly, especially for a billet, bar or wire rolling-mill roll stand train, which allows to maintain the original setting of the train of roll stand even when operating at extremely high speeds despite the accompanying wear of the guide rollers and grooved rolls so that it is possible to ensure the production of material with constant dimensions and quality and which furthermore permits a simple and rapid adaptation to suit roll pass size changes, if the size is changed to take into account a changed deformation behavior of the material to be rolled.

This object is attained by the features recited in claim 1. Further improvements of the roller guide assembly of the invention will be seen from the other claims.

The roller guide assembly in accordance with the invention may be provided with one sensor for each guide roller, but basically it is sufficient to have only one sensor, since the two guide rollers are generally so arranged that the pressure loads are equal. The or each sensor output signal may be fed to an indicating and/or recording means in order to adjust the guide rollers by set screws during operation as may be necessary to ensure that their original pressure on the material passing through the guide rollers is maintained. However it is also possible to feed the output signal of the sensor or the ouput signals of the sensors to a drive for the relative adjustment of the guide rollers or of their supporting arms in order to keep constant the original pressure of the guide rollers on the material passing through them. It is not necessary to calibrate the sensor or sensors to measure the absolute pressure of the guide rollers on the passing material, and it will suffice to detect the departure of the pressure loading of the guide rollers from a given value which may be set by means of a template or the like which is inserted between the two guide rollers of the roller guide assebmly. In a roll stand train the output signal of the sensor or the output signals of the two sensors, respectively, of a roller guide assembly of a roll stand may furthermore by used to so set the material deforming grooved rolls of a preceding roll stand that the material to be further rolled in said following roll stand will have the originally set size of cross section between the two guide rollers of the roller guide assembly. In a roll stand train the roller guide assembly in accordance with the invention makes it possible to keep the original setting "on ice". It is particularly useful for billet, bar and wire rolling-mill roll stand trains.

Embodiments of the roller guide assembly of the invention will now be described by way of example on the basis of the accompanying drawings. Therein:

DETAILED DESCRIPTION OF THE PREFERRED EMBODIMENT

Figure 1:
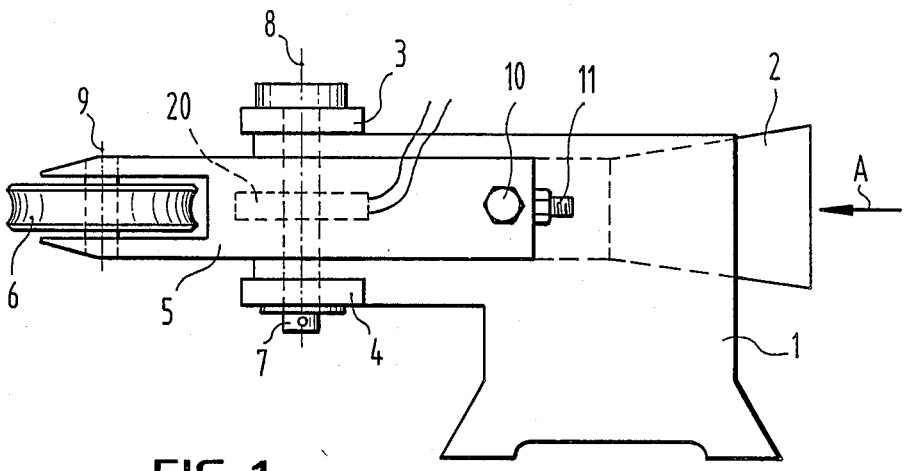
FIG. 1 is a side view of a roller guide assembly according to the invention.
Figure 2:
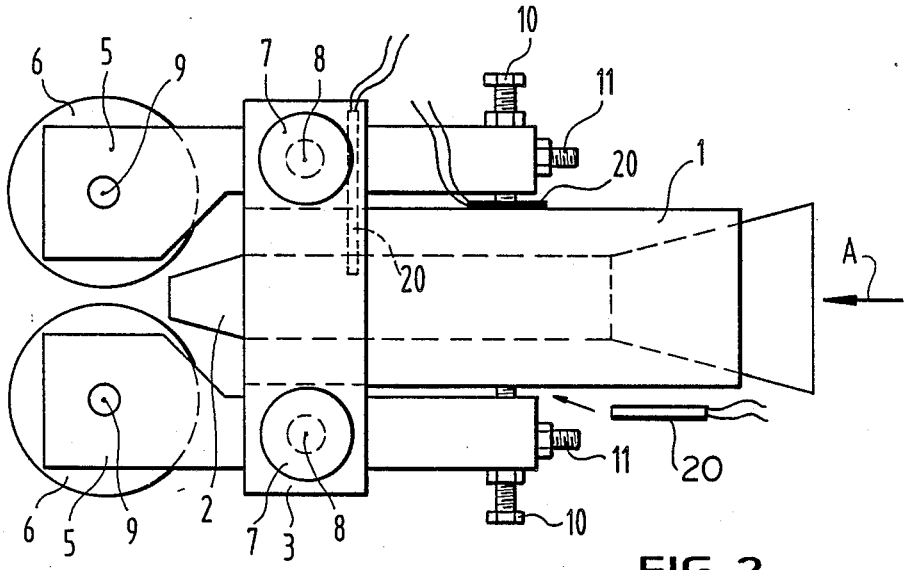
FIG. 2 is a plan view of the assembly shown in FIG. 1.

The roller guide assembly shown comprises a housing 1 for an entry guide member 2, which housing at the end shown on the left in FIGS. 1 and 2 is provided with an upper crosspiece 3 and two lower lateral eyes 4, which are aligned with the two ends of the crosspiece 3. On each side of the housing 1 extends an arm 5 supporting a guide roller 6 and accommodated between the adjacent end of the crosspiece 3 and the adjacent lateral eye 4 and pivotally mounted on the housing 1 by means of a pin 7 extending through the end of the crosspiece 3, the supporting arm 5 and the lateral eye 4 for motion about a vertical axis 8. The two guide rollers 6 are mounted at the ends, which appear on the left in FIGS. 1 and 2, of the two supporting arms 5 by means of oil-mist lubricated anti-friction bearings for turning about the parallel vertical axes 9. At the ends appearing on the right in FIGS. 1 and 2 the supporting arms 5 are each provided with a horizontal set screw 10 and a locking screw 11 for the set screw 10 through which the respective support arm 5 rests on the housing 1. The pivot axes 8 of the supporting arms 5, which are parallel to the two axes 9 of rotation of the guide rollers 6, each extend generally in the center between the axis 9 of the respective guide roller 6 and the associated set screw 10.

The housing 1 is secured to a billet, bar or wire rolling-mill roll stand in such a position that the two guide rollers 6 are precisely aligned with the pass of two grooved rolls of the roll stand. The hollow entry guide member 2 inserted into the housing 1 and the two ends of which project out of the housing 1, serves to guide the material to be rolled in said roll stand and moving in the direction of arrow A, between the two guide rollers 6, which for their part guide the material into the directly following roll pass with the correct alignment so that the axes of the cross section of the material and the axes of the pass cross section are aligned with each other. For this purose the two guide rollers 6 each have a periphery configured to match the form of the cross section of the material and the distance between the two axes 9 of rotation of the guide rollers 6 is so set that they peripherally contact the material with a certain pressure as the same passes between them.

The roller guide assembly is provided with at least one sensor 20 for detecting the pressure load of the guide rollers 6 as applied by the material passing betwen them, said sensor providing a corresponding output signal. As illustrated in FIG. 2, the sensor 20 is an electrical pressure load responsive sensor, that is to say a capsule-type pressure cell disposed between the housing 1 and one of the set screw 10 and providing an electric output signal corresponding to the pressure exerted by the set screw 10. As indicated in broken lines, the sensor 20 may also be an electrical tension load responsive sensor, for instance a wire strain gauge secured to one of the supporting arms 5 (FIG. 1) or to the upper crosspiece 3 of the housing 1 (FIG. 2) and providing an electric output signal which corresponds to the elastic elongation of the support arm 5 or of the crosspiece 3, respectively. As furthermore indicated in broken lines in FIG. 2, there may be provided two sensors 20, i.e., one for each guide roller 6. It is also possible to use a sensor 20 or two sensors 20 operating mechanically, pneumatically or hydraulically and responsive to pressure load or to tension load. However, in each case it is important to have such an arrangement that the sensor 20 or the sensors 20 detect the pressure load on the guide rollers 6 due to the material passing between them.

When adjusting, before starting the rolling process, the distance between the guide rollers 6 or their axes 9 of rotation in a workshop to match the cross section of the material to be introduced by the roller guide assembly into the associated roll pass, the pressure load of the guide rollers 6, which will be applied by said material, or the corresponding output signal of the or each sensor 20 is determined by a template or precision mandrel with the right cross section so that each change of the output signal during operation of the roller guide assembly in the rolling process will indicate a reduction (decreasing output signal) or an increase (increasing output signal) of the cross section of the material passing between the guide rollers 6 and may be used to reset the guide rollers 6 or to change the adjustment of the two grooved rolls of a roll stand preceding the roller guide assembly so that the original sensor output signal will be produced again and it is ensured that not only the two guide rollers 6 effeciently guide the material passing between them but the furthermore the material cross section between the two guide rollers 6 remains unchanged.

The following examples will explain the invention furthermore.

EXAMPLE 1

Billets of steel of the quality or hardness 5 and measuring 120 mm by 120 mm were rolled out to wire with a diameter of 5.5 mm in a continuous wire rolling-mill comprising a train of 24 roll stands. The firsts 14 stands were individual drive horizonal roll stand with a pass sequence "oval-oval-square-oval-round . . . ". The ovals were placed upright by roller twist devices and held by roller guide assemblies as in FIGS. 1 and 2 but without sensors 20. The following 10 roll stands each having a round roll pass were grouped together as a twist-free high speed block with a group drive, the gearing stage of each roll stand being designed to suit the decrease in the cross section of the material to be rolled.

At the first roll stand the rolling speed was 0.12 meter/sec and at the last one 73 meter/sec. The forming behavior, which varied owing to the grooved rolls becoming rougher, was compensated for by opening or closing the rolls. There were occasional unsatisfactory rolling runs in the high speed block. During a 24 hour period of rolling a time utilisation factor of 80% and a yield factor of 96.3% were obtained. The so-called 2a fraction of the wire, which was outside the tolerance range owing to being non-round and to the presence of roll-flash, amounted to 1.2%. Replacement of the roller guide assemblies was necessary. Examination of the replaced roller guide assemblies of the seventh and eighth roll stand showed that the supporting arms 5 were deformed. They had to be replaced by new supporting arms 5.

EXAMPLE 2

Billets of the type specified in example 1 were also rolled out to wire with a diameter of 5.5 mm using the same roll stand train but fitted with the roller guide assemblies of FIGS. 1 and 2 in accordance with the invention. The roller guide assemblies having the sensors 20 were optically adjusted and then set with a precision mandrel to an electric sensor output signal. The grooved rolls of the roll stands were also set by means of precision feelers.

The wire produced from the first billet was dimensionally accurate and capable to be sold as a so-called 1a product. During the rolling process the electric sensor output signals from the roller guide assemblies of the seventh and ninth roll stands increased, and this was compensated for by closing the grooved rolls of the sixth roll stand. The wire of the last roll stand became over filled, and this was corrected by closing the grooved rolls of the fourteenth roll stand. However, the consequence of this was that the electric sensor output signal of the roller guide assembly of the fifteenth roll stand fell to a value of zero. Therefore, the grooved rolls of the fourteenth roll stand were opened again in order to return to the original oval thickness and to obtain again the original value of said electric sensor output signal, and instead the grooved rolls of the thirteenth roll stand were closed, this leading to a smaller oval width at the fourteenth roll stand without, however, having any effect on the roller guide assembly of the fifteenth roll stand.

After a 24 hour period of rolling in this roll stand train with a roller guide assembly in accordance with the invention fitted to all roll stand into which material having an oval cross section entered, a time utilisation factor of 85% and a yield factor of 97.1% were obtained. The 2a fraction was 0.3% and was only due to unroundness, since there was no roll-flash. The working life of all roller guide assemblies was increased by more than 10%.

What is claimed is:

1. A roller guide assembly for guiding a length of rolled material leaving the pass of a previous roll stand and entering the pass of a subsequent roll stand, which roll stands form a part of a billet, bar or wire rolling-mill roll-stand train, the assembly including:

(a) a supporting structure disposed between the passes of previous and subsequent roll stands;

(b) a pair of guide rollers mounted for rotation about two parallel axes on the supporting structure for engaging opposite sides of the material after the material has been compressed in the pass of the previous roll stand;

(c) the supporting structure includes a housing, an entry guide member for guiding the material towards the guide rollers, a pair of arms supporting the guide rollers, the entry guide member being at least partially disposed within the housing, and the arms extending in the longitudinal direction of the entry guide member and being mounted on the housing to pivot about two axes parallel to the axes of rotation of the guide rollers;

(d) sensor means disposed on the supporting structure for detecting pressure transmitted to the guide rollers by the material in engagement therewith, the sensor means providing an output signal in correlation with the pressure; and (e) means for adjusting the guide rollers in response to the output signal in order to maintain a constant pressure transmitted to the guide rollers, thereby compensating for wear of the guide rollers and pass of the previous roll stand so that a constant cross section and proper guidance is maintained for the material entering the pass of the subsequent roll stand.

2. The roller guide assembly of claim 1 wherein the sensor means is mounted on the housing.

3. The roller guide assembly of claim 1 wherein the sensor means is mounted on one arm.

4. The roller guide assembly of claim 1 wherein the sensor means is mounted between the housing and one arm.

5. The roller guide assembly of claim 1 wherein the sensor means is responsive to pressure load.

6. The roller guide assembly of claim 5 wherein the sensor means is a capsule-type pressure cell.

7. The roller guide assembly of claim 1 wherein the sensor means is responsive to tension load.

8. The roller guide assembly of claim 7 wherein the sensor means is a wire strain gauge.

9. The roller guide assembly of claim 1 wherein the sensor means includes two sensors disposed on the supporting structure for detecting the pressure transmitted to each of the guide rollers from the material in contact therewith, with each sensor providing an output signal to the adjusting means in correlation with the detected pressure.

* * * * *

UNITED STATES PATENT AND TRADEMARK OFFICE

CERTIFICATE OF CORRECTION

PATENT NO. : 4,790,164

DATED : December 13, 1988

INVENTOR(S) : Herbert Rothe

It is certified that error appears in the above-identified patent and that said Letters Patent is hereby corrected as shown below:

Col. 1, Lines 10 and 11: delete "mate[-]rail" and insert therefor: -- material --;

Col. 1, Line 62: after "wear" and before "thereof", insert: -- of the grooved rolls of the stands, just as the gap between the guide rollers will change owing to wear --;

Col. 2, Line 52: delete "assebmly" and insert therefor: -- assembly --;

Col. 3, Line 54: delete "betwen" and insert therefor: -- between --;

Col. 4, Line 39: delete "firsts" and insert therefor: -- first --;

Col. 4, Line 40: delete "stand" and insert therefor: -- stands --;

Col. 5, Line 30: delete "stand" and insert therefor: -- stands --.

Signed and Sealed this

Nineteenth Day of September, 1989

*Attest:*

DONALD J. QUIGG

*Attesting Officer*

*Commissioner of Patents and Trademarks*